US005732521A

United States Patent [19]

Schmitt-Raiser

[11] Patent Number: 5,732,521

[45] Date of Patent: Mar. 31, 1998

[54] LONGITUDINAL OR TRANSVERSE SUPPORT FOR CEILING PANELLING

[75] Inventor: Karl-August Schmitt-Raiser, Wetzlar, Germany

[73] Assignees: Wilhelmi Werke Aktiengesellschaft, Lahnau; Suckow + Fischer GmbH, Biebesheim, both of Germany

[21] Appl. No.: 620,440

[22] Filed: Mar. 22, 1996

[30] Foreign Application Priority Data

Mar. 24, 1995 [DE] Germany ..... 195 10 741.1

[51] Int. Cl.[6] ..... E04B 2/00; E04B 5/00; E04B 9/00

[52] U.S. Cl. ..... 52/506.07; 52/506.06; 52/506.05; 52/508; 52/664

[58] Field of Search ..... 52/506.07, 506.06, 52/506.05, 508, 664

[56] References Cited

U.S. PATENT DOCUMENTS

| | | | |
|---|---|---|---|
| 3,276,179 | 10/1966 | Rallis | 52/508 |
| 4,554,718 | 11/1985 | Ollinger et al. | 29/155 R |
| 4,663,911 | 5/1987 | Gracia | 52/506.06 |
| 4,678,487 | 7/1987 | Codwell, Jr. et al. | 52/506.06 X |
| 4,817,357 | 4/1989 | Hocevar | 52/732 |
| 4,852,325 | 8/1989 | Dunn et al. | 52/506.07 X |
| 4,932,186 | 6/1990 | Jahn | 52/729 |
| 4,949,517 | 8/1990 | Blitzer et al. | 52/506.06 X |
| 5,050,360 | 9/1991 | Gailey | 52/506.06 |
| 5,088,261 | 2/1992 | Mieyal et al. | 52/729 |

FOREIGN PATENT DOCUMENTS

| | | |
|---|---|---|
| 237 651 | 9/1987 | European Pat. Off. . |
| 1 207 244 | 2/1960 | France . |
| 76 130 | 1/1962 | France . |
| 2 206 425 | 6/1974 | France . |
| 2 549 933 | 2/1985 | France . |
| 94 13 816 U | 1/1995 | Germany . |
| 822 043 | 10/1959 | United Kingdom . |

OTHER PUBLICATIONS

Company brochure "Konstruktion 200" of the Suckow + Fisher GmbH company (pp. 29–34, 6 pages).

*Primary Examiner*—Carl D. Friedman
*Assistant Examiner*—W. Glenn Edwards
*Attorney, Agent, or Firm*—Flynn, Thiel, Boutell & Tanis, P.C.

[57] ABSTRACT

Longitudinal or transverse supports for a ceiling panelling holding construction of T-shaped, bent sheet metal plates and ceiling tiles connected to said sheet-metal plates are supposed to be strong and at the same time, however, be of a light weight. The grooves of the surface image are thereby supposed to be very narrow and are supposed to be formed, instead of by the supports, rather by the ceiling tiles themselves, which are supposed to be designed individually capable of being assembled and disassembled. The invention uses for this purpose specially built supports, into which the ceiling tiles can be suspended, which, however, can also be set up to support such ceiling tiles.

20 Claims, 8 Drawing Sheets

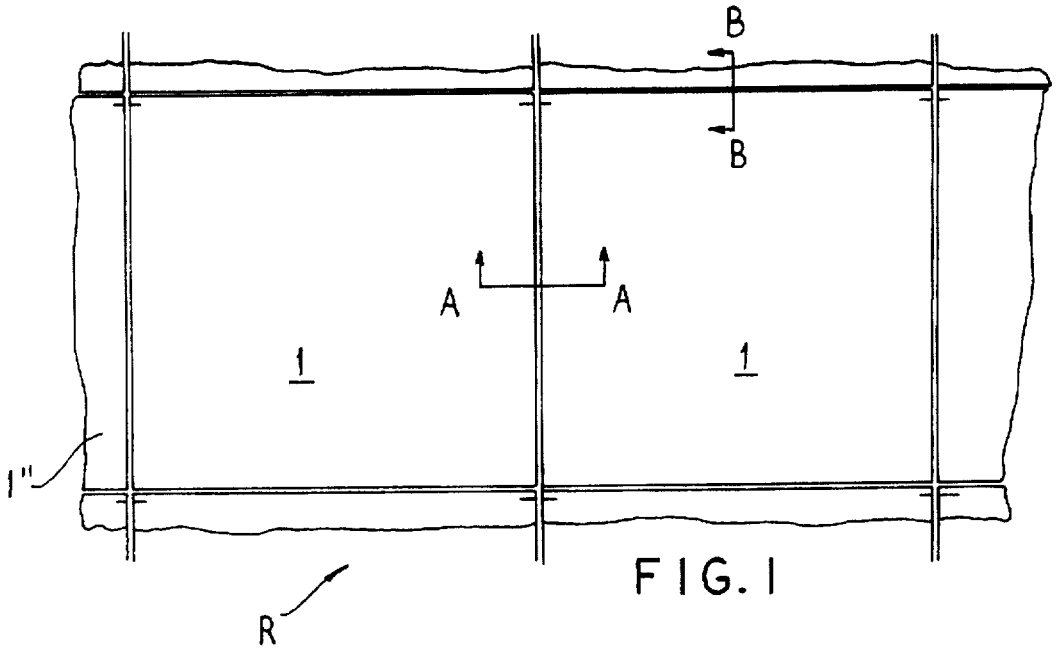
FIG. 1
FIG. 2
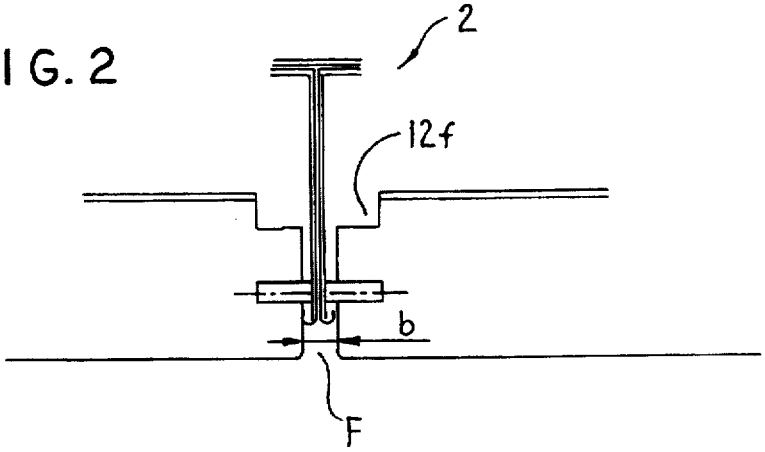
FIG. 3
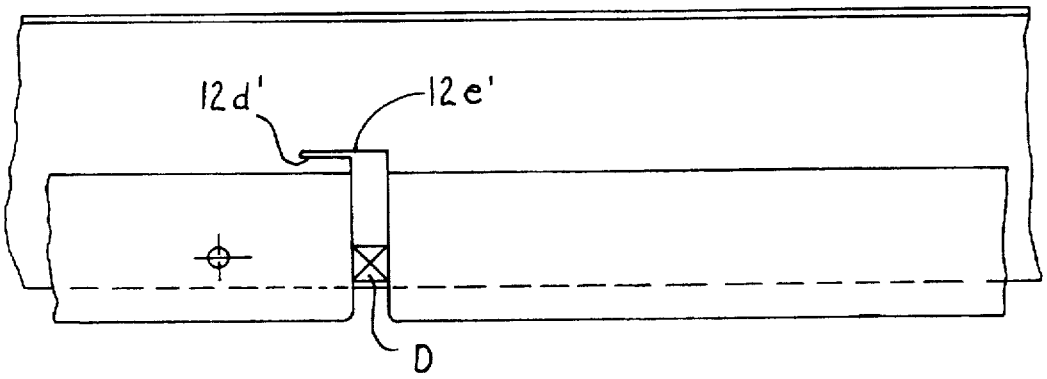

LONGITUDINAL OR TRANSVERSE SUPPORT FOR CEILING PANELLING

FIELD OF THE INVENTION

The invention relates to longitudinal or transverse supports for a ceiling panelling holding construction essentially formed of T-shaped, bent sheet-metal plates, forming a surface image out of adjacent ceiling tiles (or raster) and being able to be inserted between two parallel supports and being releasably held on the same.

BACKGROUND OF THE INVENTION

Such insert constructions are known, for example, from the company brochure "Konstruktion 200" of the Suckow+ Fischer GmbH company, where they are designated to hold ceiling tiles of plaster, metal, pressed wood chips and the like, which are placed onto the transverse strips of longitudinal and transverse supports, just filling the inside dimensions between the strips.

It is, of course, understood that the bent profiles are thereby supposed to project as little as possible over the strips so that the width of the transverse strips, which width is usable for the support of the ceiling tiles, is not unnecessarily limited. The areas bent out of the plane of the strips are therefore designed equally wide on each side so that the strip edge falls exactly centrally in the zenith of the bent profile; this is at least necessary for the supports when the insert construction is thereby suspended on the bent profiles, whereby the suspensions are introduced through the gap into the inside of the respective bent profile. The central arrangement of the zenith on the support profile assures that the supports experience no torque.

Because the connecting plates for binding the transverse supports into the supports at least partially grip over the bent profiles and thus narrow the interior widths available to the ceiling tiles in the area of these bent profiles, so that the transverse strips must be designed significantly wider in order to guarantee a reliable support of the ceiling tiles, the DE-Gebrauchsmusterschrift 94 13 816 suggests a reversed T-shaped, bent profile for the supports, which has only an eyelet-like, narrow enlargement of the upper part used as a mounting, whereby a suspension can be placed into fitting slots of this part. A relatively easy design of the insert construction is obtained in this manner, the dimension of which can be calculated alone according to static viewpoints, whereas the structural design of the insert construction plays no role or at least a subordinate role. Of course the necessary bent profiles are of a relatively complicated design and require a number of bends, partly in the direct vicinity of one another. However, mainly the strips always lying at the bottom determine the form and the size of the surface image visible from the room.

SUMMARY OF THE INVENTION

Compared with this, the purpose of the invention is to design a support of the type identified in detail above for a holding construction with easily manufacturable structural elements, in which the grooves shown in the surface image can be kept very narrow and are formed by the support instead of by the ceiling tiles themselves, which are supposed to be designed individually capable of assembly and disassembly, and which construction can hold a variable number of tiles at least between very inherently stable supports. The entire support is thereby supposed to do without chip-removing machining and without containing self-locking compounds in order to reliably obtain a, for example, galvanic coating for its structural elements.

The purpose according to the invention is initially attained by each support consisting of a sheet-metal base member designed in T-form and a reinforcing sheet-metal member, the sheet-metal base member is composed in one piece out of a first double-wall strip part constructing the cross piece of the T-form and a double-wall second strip part vertically following same forming the stem, the first and the second strip parts are bent out of one single first sheet-metal strip to form a horizontal abutting outer and two inner belt strips and two (vertically) abutting second strips, the first strip part is enveloped by a reinforcing sheet metal member, and the reinforcing sheet-metal member is composed of a single second sheet-metal strip bent forming over the first strip part, whereby the parallel edges of the first sheet-metal strip form together the free edge of the second strip part and the parallel edges of the second sheet-metal strip are provided as the longitudinal wedges on both sides between the first and the second strip parts.

Such a support can be easily manufactured out of a galvanically coated sheet-metal plate without that the coating would have to be damaged locally by punching-out openings or spot weldings or other interfering areas. The first strip part of the support can thereby be manufactured for the mounting of the reinforcing sheet-metal member with a particularly high portion of its resistance moment on the support and is at the same time already by itself extraordinarily inherently stable.

The invention is further characterized such that the edges of the first sheet-metal strip are bent to form horizontal first guide grooves pointing away from the second strip part, into the grooves are guided holding pieces for the ceiling tiles, which holding pieces can be moved along the length of the support. In this manner the condition is given that the ceiling tiles and all other structural elements connected to the supports can be connected to the holding construction without having to be screwed or welded to the supports, so that they no longer must be galvanized after their complete manufacture but, in accordance with the purpose, can be previously manufactured from suitably coated sheet-metal plates.

It is advantageous when the guide grooves have a semicircular cross section because this shape can be formed without any problems and enables a safe guiding of the holding pieces, without which these can get wedged on the supports. A further guiding of the holding pieces is automatically created by the edges of the second sheet-metal strip ending spaced from the second strip part and the holding pieces being guided in the second guide grooves in this manner constructed on both sides of the second strip part and following the first strip part, and each being defined by one of the edges and the second strip part. They can, in this manner, be moved as desired along their support and can be moved into a position, in which a structural element is connected to the support. This permits the supports to be extremely versatile in their use, without this, the supports would have to be adjusted in each case. Rather, the supports can be manufactured together with equal length and can be stored. They can be adapted to the local conditions during assembly to the complete holding construction, without this a further special machining would be needed.

Each holding piece consists advantageously of a flat sheet-metal piece and at least one holding element fastened to the sheet-metal piece for the associated ceiling tile. The holding element can thereby also be releasably fastened to the sheet-metal piece. As a rule, the flat sheet-metal piece remains in place when the structural element connected thereto is installed, without this, it would have to be connected to the support in another way other than through the two guide grooves.

The entire arrangement of the holding construction is extremely inherently stable when the ceiling tile is form-lockingly connected to the holding element. The holding element can, for this purpose, be designed bolt-shaped and can project into the area of the associated ceiling tiles. It is understood that for this purpose the ceiling tile must have suitable recesses or other formed elements, which form-lockingly correspond to the holding element. Such connections are possible in many different designs, it is particularly favorable when they are easily releasable through a change in position of the participating structural elements such that the ceiling tile can be easily removed from the holding construction. The details of such connections are of common knowledge in this technical field.

Aside from the ceiling tiles it is, for example, also possible as before, to connect transverse supports without any problems to the longitudinal supports. It is possible for this purpose to guide plate pieces in the same guide grooves as used by the holding pieces, to which plate pieces such transverse supports can be connected, which are then clamped between the supports. Transverse supports are needed when the inside width of the ceiling tiles is too large, in particular also when, as will yet be explained, the provided supports are reversed T-shaped with ceiling tiles resting thereon, as is known from the DE-Gebrauchsmuster 94 13 816.

The ceiling tiles can each be bent out of a sheet-metal blank, in particular in such a manner that they consist of a flat, horizontal, preferably rectangular surface piece facing the room and being adjusted to the surface image, and edge are pieces bent at a right angle on all sides and lying in the area of the supports. The ceiling tiles are particularly inherently stable when the edge pieces are connected with one another at their abutting edges.

The surface image is thus formed by the surface pieces of the ceiling tiles, mainly when they extend below the supports, whereas the edge pieces of the ceiling tiles can also be utilized for locking. The ceiling tiles are designed box-shaped and can, if necessary, additionally be filled with insulation, however, as a rule it is sufficiently possibly for the design of an acoustic ceiling to later coat the surface pieces.

The supports of the invention are particularly advantageous when flanges are designed in the ceiling tiles on their edge pieces extending transversely with respect to the supports, preferably in one piece with these, and are designed such that they can be placed one on top of the other and that thereby one of the abutting ceiling tiles is supported on the one side on another adjacent one, and on the other side supports a third adjacent one. Such an arrangement permits the elimination of transverse supports; the ceiling tiles, however, are still safely supported because they are supported on three sides. The stability on the fourth side of the adjacent ceiling tile can be improved by the ceiling tile being held on this side on the adjacent supports by at least one holding piece on both sides.

A uniform groove width between the ceiling tiles is obtained in a simple manner when the edge pieces of adjacent ceiling tiles, which edge pieces are provided with flanges, abut on both sides of a spacer fastened to at least one of the associated supports. It is also sufficient for the spacer to be only temporarily and provisionally provided and not at all fixedly connected to the support.

The reciprocal support of the ceiling tiles is made possible by the flanges being designed as continuous flat sheet-metal plates on the edge pieces pointing in the same direction when the edge pieces abut. One ceiling tile rests thereby on an adjacent one, however, it can be lifted off in upward direction. The arrangement of a ceiling tile on the holding piece can therefore be such that the ceiling tile is pivotal about the holding elements provided on the sheet-metal pieces of these holding pieces.

The described design of the supports is mainly intended for a holding construction, in which the strip parts of the supports are oriented lying on top above the ceiling tile. However, deviating from this, it is also possible just like in the known holding construction that the supports are arranged such that their strips lying at the bottom serve as a support for the ceiling tiles. A suspension of the supports can be easily designed in such an arrangement by providing openings, like slots or the like, in the strips of the supports, in which openings suspensions for the supports can be locked. It is thereby particularly advantageous when the suspensions end in flat holding plates, which can be moved into the double-wall strip of the respective support and are provided with spring pieces or tabs formed in one piece thereon, which spring pieces engage the openings in such a manner that they thereby fix the support.

It is sufficient in the case of such a suspension to slightly fan out the two strip segments of the upwardly pointing strip of a support and to introduce the respective holding plate so far into the strip segment such that its spring piece engages one of the openings provided therein and locks the suspension to the support. A light bulging of the strip segment at this point can be easily taken into consideration when designing the guide of the holding pieces and/or plate pieces so that these have sufficient clearance in the guide grooves in order to prevent a wedging at the bulges; also a dot-like instead of a flat bearing on the holding pieces and/or on the plate pieces of the strip segments can be useful. In addition the sheet-metal pieces of the holding pieces are mostly right from the start, because of the special design of the guide grooves, spaced sufficiently far from the strip segments.

A holding construction with the supports of the invention results in a very light construction, which as a whole also reduces the stress on the ceiling.

At any rate the design and also the efficient manufacture of the supports are of great importance.

A support of this type, which consists of a sheet-metal member base forming a T-form and formed out of one single, double-walled first sheet-metal strip bent into a horizontal first strip part and a vertical second strip segment following same at a right angle, and a reinforcing sheet-metal member covering the first strip part on both sides, and resting each flat surface on its first strip part, out of one single second sheet-metal strip bent forming over the first strip part whereby. The parallel edges of the first sheet-metal strip form together the free edge of the second strip part, and the parallel edges of the second sheet-metal strip are provided in the longitudinal wedges on both sides between the second and the first strip part, can be manufactured according to the invention in such a manner that, first, the sheet-metal base member is manufactured out of the first sheet-metal strip in such a manner that the two inner strip segments of the double-wall first strip part, which strip segments follow the second strip part, are bent only so far from the outer strip segment and the second strip part so that the second strip part, when the edges contact one another, define with one another and the inner strip segments with the outer strip segments an acute angle, and then second, the sheet-metal strip is formed in such a manner over the first strip part that the thereby formed reinforcing sheet-metal member is bent with its inner edge plates resting on the inner strip segments at 180° out of the sheet-metal strip resting on the outer strip segment in such a manner that thereafter the inner strip segments rest on the outer strip segments and the second strip parts rest flat on one another.

Thus the sheet-metal base member is initially not yet put into its final form; this is done only by the reinforcing sheet-metal member formed thereabove so that the surfaces of both sheet-metal members lying one on top of the other are guyed against one another under a considerable initial tension, and in this manner guarantee that a reinforcing sheet-metal member sits very tightly on the sheet-metal base member, even when the remaining elasticity of the sheet metal being used is not high. Also, the sheet-metal base member of the support receives its final form only after its connection to the reinforcing sheet-metal member. Since as a whole, only a few bending operations are needed and the bends on the support are spaced relatively far from one another, such a support can now be manufactured very economically and exactly out of two simple sheet-metal blanks, also especially in the case of the holding constructions of the invention, no after-treatment whatsoever is needed and a galvanic coating can, if necessary, be provided already on the two sheet-metal strips.

BRIEF DESCRIPTION OF THE DRAWINGS

The invention will be discussed hereinafter in greater detail in connection with one exemplary embodiment illustrated in the drawings, in which:

FIG. 1 is a bottom view of a ceiling of a room having a ceiling panel holding construction with supports designed according to the invention;

FIG. 2 is a slightly enlarged cross-sectional view taken along the line A—A of FIG. 1;

FIG. 3 is a slightly enlarged cross-sectional view taken along the line B—B of FIG. 1;

DETAILED DESCRIPTION OF THE DRAWINGS

A support according to the invention is used for holding ceiling tiles 1 (1', 1") which, according to FIG. 1, are inserted into a surface image R and are held on supports 2 corresponding to FIGS. 2 and 3, which supports extend parallel to one another from one wall of the room to the other and are secured either to the existing ceiling of the room or to the walls of the room. Very narrow image grooves F are constructed throughout between the ceiling tiles 1, the groove width b along the supports 2 depends on the design of the supports 2 which will be described hereafter, and transversely thereto on spacers D (FIG. 3) which, at least periodically, are provided on the supports 2.

Figure 4:
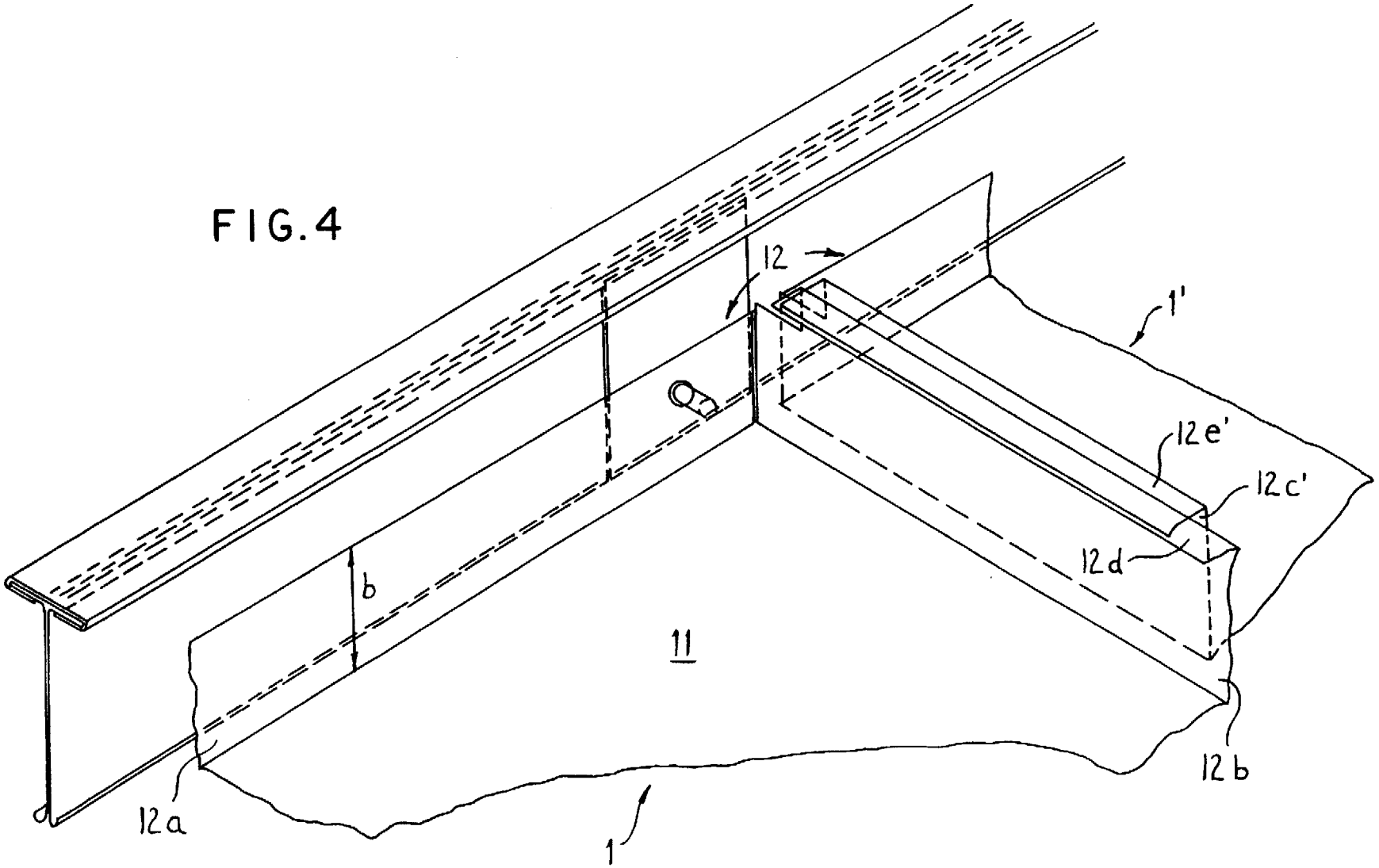
FIG. 4 is an isometric view from above of a junction joint of FIG. 2.

FIG. 4 shows that the ceiling tiles 1, 1' are designed box-shaped by having edge pieces 12 angled upwardly on all sides from a flat surface piece 11 determining the surface image R, which edge pieces determine the height or thickness h (FIG. 4) of the respective ceiling tile 1. Two front-side edge pieces 12*a* are thereby provided for holding the ceiling tile 1 on the two supports 2, between which the ceiling tile 1 is clamped, whereas the edge pieces 12*b* and 12*c'* along the side serve as the reciprocal support of two adjacent, abutting ceiling tiles 1, 1' (FIG. 4). The reference numerals of the ceiling tile, which is the rear one in FIG. 4, are identified with a prime symbol for a better differentiation.

The support 2 can be particularly well recognized in its details in FIGS. 2 and 4 to 6. It consists of shaped strips of sheet metal 210 and 220 in a compound construction out of a sheet-metal base member 21 and a reinforcing sheet-metal member 22.

A first sheet-metal strip 210 is thereby bent several times to form an integral double-wall first strip part 21*a* and an also double-wall second strip part 21*b* with the second strip part 21*b* being cantilevered from the first strip part 21*a*. The first strip part 21*a* and the second strip part 21*b* are initially preformed, corresponding to FIG. 5, such that the inner strip segments 21*a,i* transferring into the strip part 21*b* define with the outer strip segments 21*a*,á at the upper end of the sheet-metal base member 21 an acute angle w1 therewith and the strip segments 21*b,s* define an acute angle w2.

The sheet-metal base member 21 is bent such that the free edges 210*a* of the first sheet-metal strip 210 terminate at the end of the strip part 21*b* remote from the strip part 21*a* and, furthermore, extend parallel to one another. They are each shaped into an upwardly open semicircular cross section HK so that on both sides of the strip part 21*b* there is formed a first guide groove N1. It is particularly clear from FIG. 5 that the guide grooves N1 are used for horizontally guiding a holding piece 3 parallel on the support 2, to which holding piece an edge piece 12*a* on a ceiling tile 1 can be fastened. Such a holding piece 3 consists of a flat sheet-metal piece or plate piece 31 to which is fastened a holding element 32 projecting into the area of the ceiling tile 1 to be held. The here rectangular sheet-metal piece 31 with the lower edge 31*a* thereof being slidable in the guide groove N1 and the upper edge 31*b* thereof being movably supported in a second guide groove N2, is movable along the support 2. The second guide groove N2 formed between the edges 220*a* of the second sheet-metal strip 220, do not reach all the way to the strip segments 21*b,s* of the strip part 21*b* so that both of the guide grooves N2 are respectively limited by an edge 220*a* a strip segment 21*b,s* and an inner strip part 21*a,i*. Of course, it is advantageous to arrange the holding piece 3 with clearance in the elevational direction in the guide of the guide grooves N1, N2 so that they can be moved without any difficulties into the guide.

Figure 5:
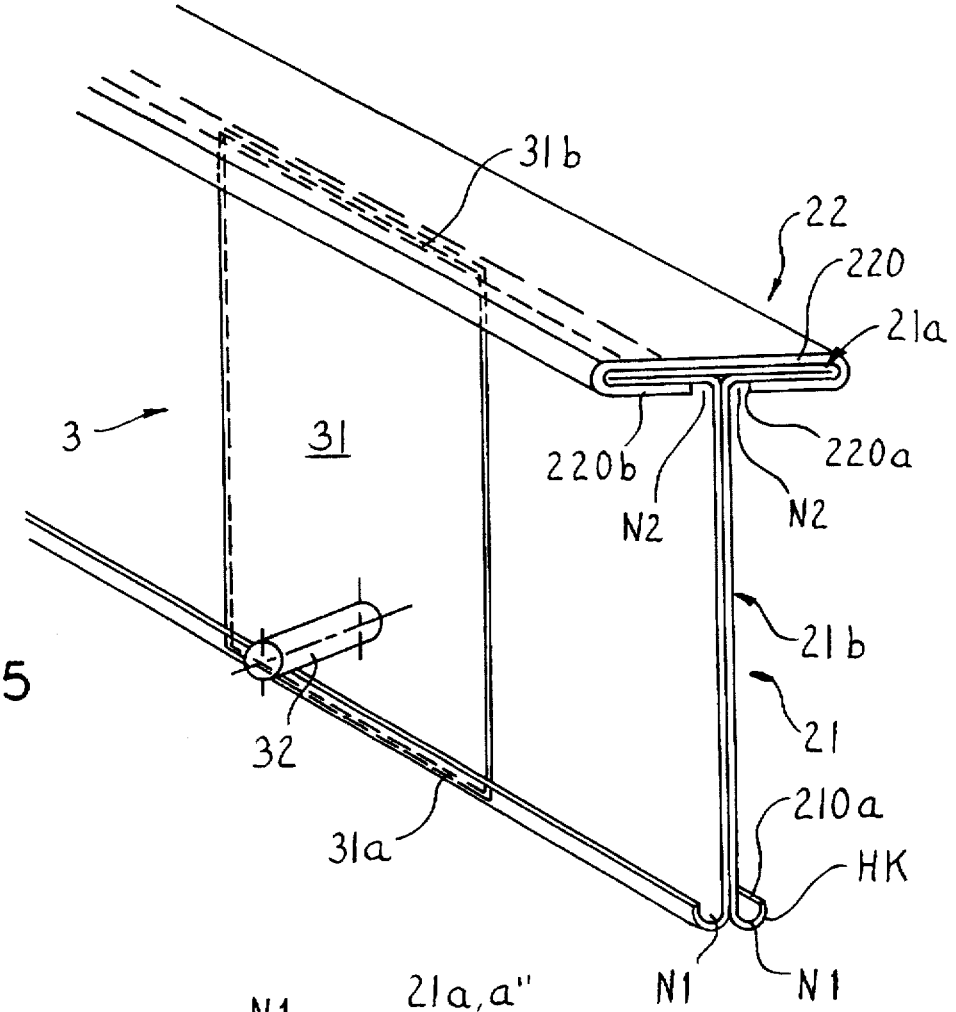
FIG. 5 is an isometric illustration, again slightly enlarged, of a support of a holding construction and embodying the invention.
Figure 6:
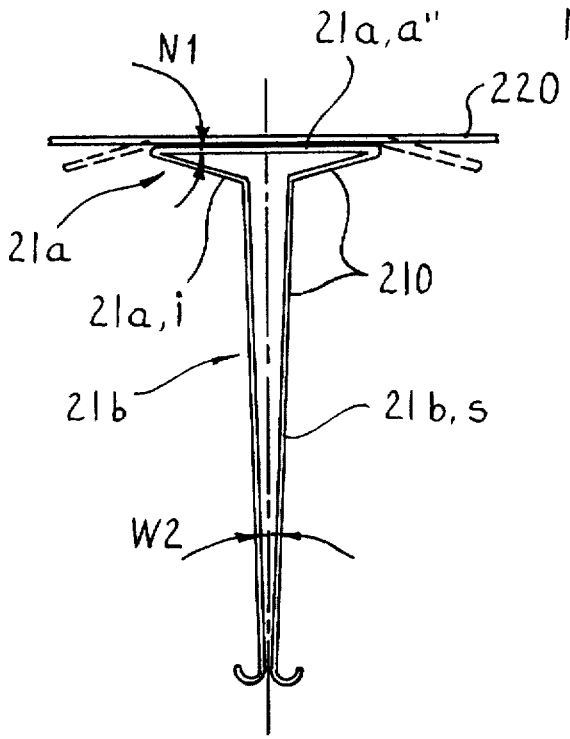
FIG. 6 is a front view of the support of FIG. 5.

The second sheet-metal strip 220 is bent to form the reinforcing sheet-metal member 22, as is clearly shown in FIG. 5. The initially temporary bend of the sheet-metal base member 21 with the angles w1 and w2 is brought into its final form by applying the reinforcing sheet-metal member 22 and its associated inner edge plates 220*b* forcing the angles w1 and w2 to disappear. The edges 220*a* press thereby the longitudinal strip parts 21*b*, 21*b,s* and 21*a,i* into their final 90°, horizontal and vertical, form or, in other words a T-form with strip part 21*a* being the cross piece and strip part 21*b* being the stem.

FIGS. 2 and 4 show the holding elements 32 as bolts, which each extend through a hole punched into the sidewall or edge piece of the tile and rotatably support the tile so that it can be pivoted downwardly out of the ceiling plane and open to reveal openings into the ceiling cavity.. Also other connecting parts or connecting elements in the place of the holding element 32 are possible, whereby a form-locking engagement is always supposed to occur. Of course, it is thereby advantageous when the form locking can be released in case the respective ceiling tile 1 is supposed to be removed from the holding construction.

Transverse supports between the longitudinal supports 2 for placement of the ceiling tiles are as a rule not needed in a holding construction according to the invention. Instead a flange 12*d*, 12*e*' each is bent on the mutually adjacent edge pieces 12*b*, 12*c*' (FIG. 4), namely, in such a manner that they point or extend in the same direction and lie flat on one another when the ceiling tiles 1, 1' are mounted, whereby the bearing flange 12*e*' rests on the support flange 12*d*, near which the ceiling tile 1 rests on the holding elements 32 on both sides. The bearing elements on the ceiling tile 1 are complementary to the holding elements 32 and have been left out of the drawing, are supposed to make it possible, as mentioned, to release the form locking with the holding elements 32 when the ceiling tiles 1, 1' and in particular the ceiling tile 1' are pivoted reciprocally about the holding elements 32, and the flanges 12*d*, 12*e*' disengage thereby. It is then assured that each individual ceiling tile 1 can be removed from the holding construction without changing anything else on the holding construction. The pivoting capability of the ceiling tiles 1 is improved when the flanges 12*d*, 12*e*' are notched as at 12*f* (FIG. 2) and the height of the edge pieces 12*a* is as low as possible, as this is shown in FIGS. 2 to 4.

Figure 7:
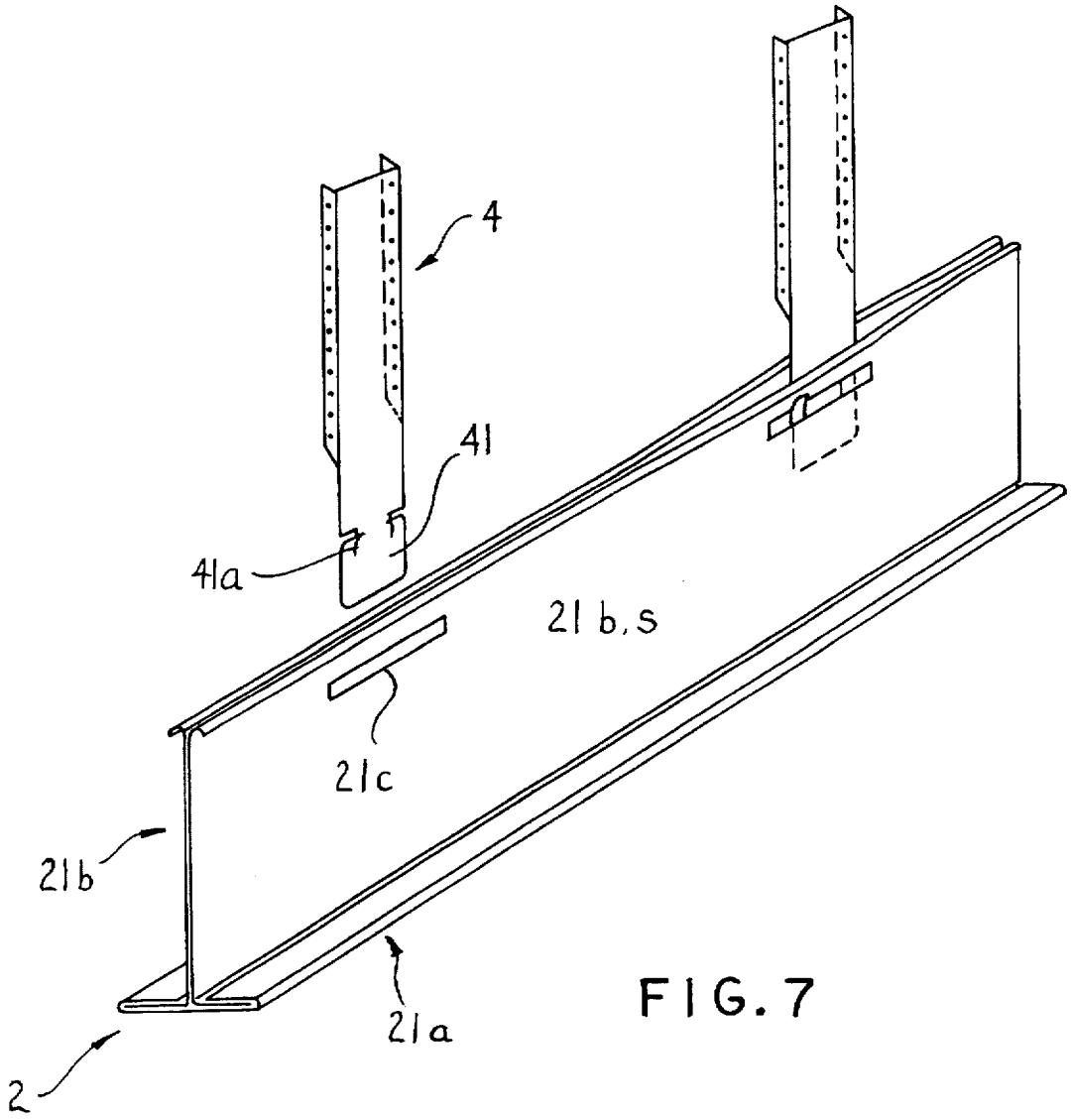
FIG. 7 is an arrangement of a support of the invention, which arrangement has been slightly modified compared with the ones of FIGS. 1 to 3.

FIG. 7 shows that the T-shaped supports 2 can also be reversed or inverted so that the strip part 21*a* can be used as a base for the ceiling tiles not shown in the drawing, and the strip parts 21*b* are provided for fastening of the supports 2 on suitably designed suspensions 4. The suspensions 4 are to be fastened to the existing ceiling of a room and terminate in flat holding plates 41 which are moved between the strip segments 21*b,s* and received, each with spring pieces or tabs 41*a* provided at their ends, into fitting openings 21*c* provided in the sheet-metal base member 21, and in this manner lock the supports 2 and the suspensions 4 together. Such an opening is provided, in FIG. 7, as a slot in the strip part 21*b*, whereby the spring pieces or tabs 41*a* do not project beyond the slot and therefore do not hinder the movement of the holding pieces 3 along the support 2. FIG. 7 shows that the strip segments 21*b,s* are in the area of the suspension 4 slightly widened by said suspension; this can be limited to such a degree that again there is no fear that the holding pieces 3 would be hindered in their movement along the support.

Figure 8:
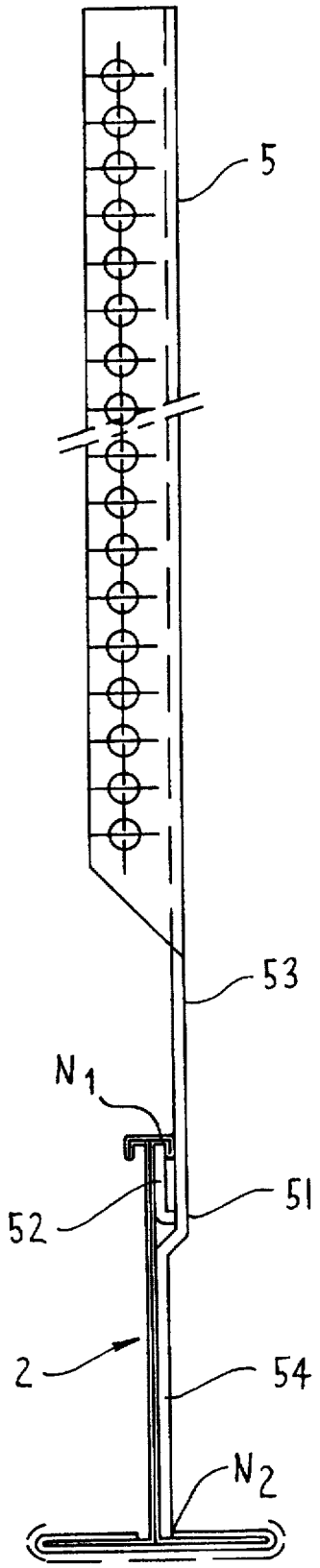
FIGS. 8 and 8*a* are each a side view of a support held, according to the invention, by means of a hanger.
Figure 8A:
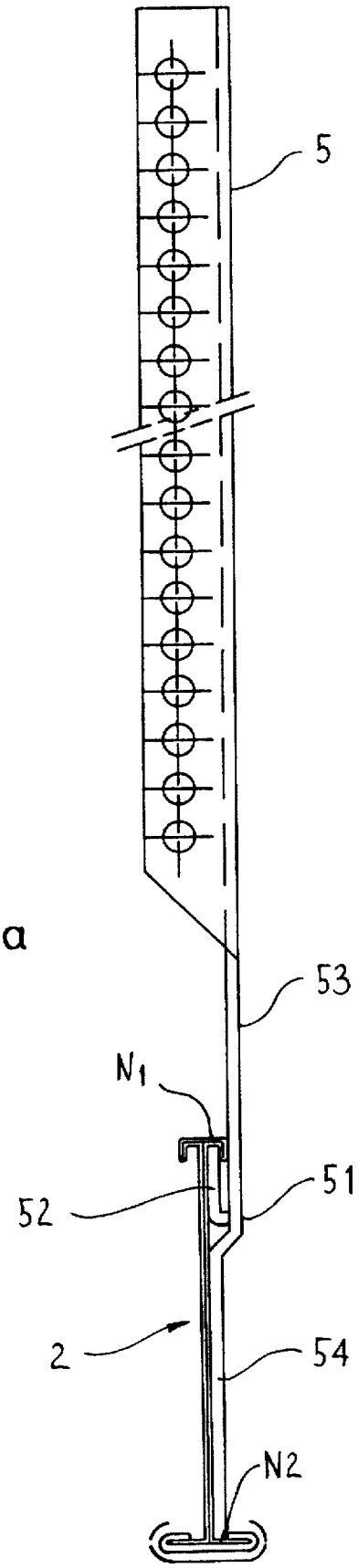

FIGS. 8, 8*a* show an alternative suspension for the support, in which as a modification of FIG. 7 slots 21*c* in the strip part 21*b* can be eliminated.

The suspension 5 consists of a bent sheet-metal strip 51, from which a tongue 52 is bent, which extends parallel to a section 53 of the suspension 5. This tongue 52 is received in the guide groove N1 of the support. The second section 54 of the suspension 5 is received in the groove N2 of the support 2, whereby the distance of the end of section 54 and of the tongue 52 corresponds essentially to the height of the support 2. The suspension 5 is then fastened in the usual manner to the subconstruction at an end thereof distal the support 2.

Figure 9:
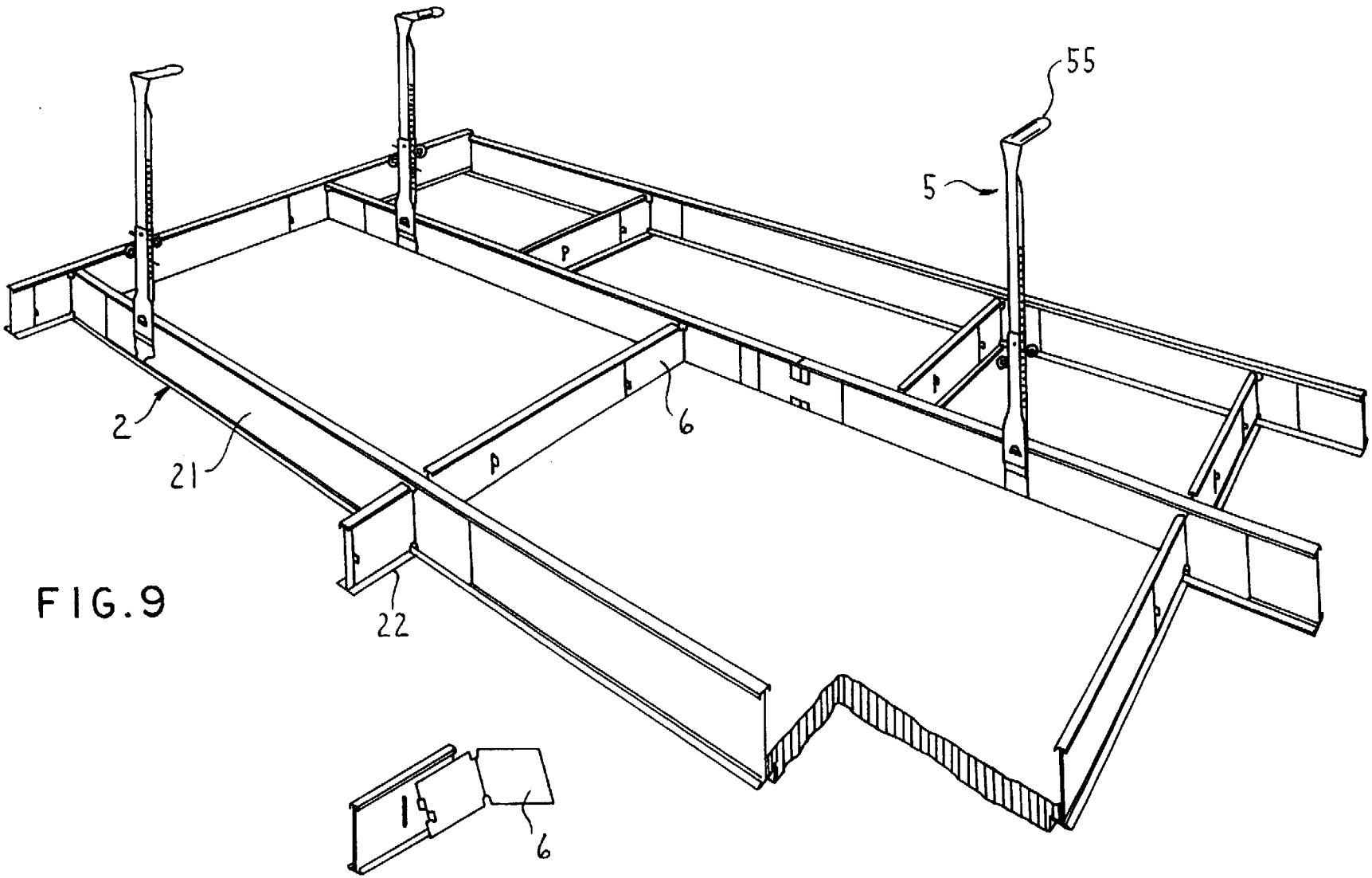
FIGS. 9 and 9*a* are each schematically simplified perspective views of a ceiling secured by means of a holding construction embodying the invention.
Figure 9A:
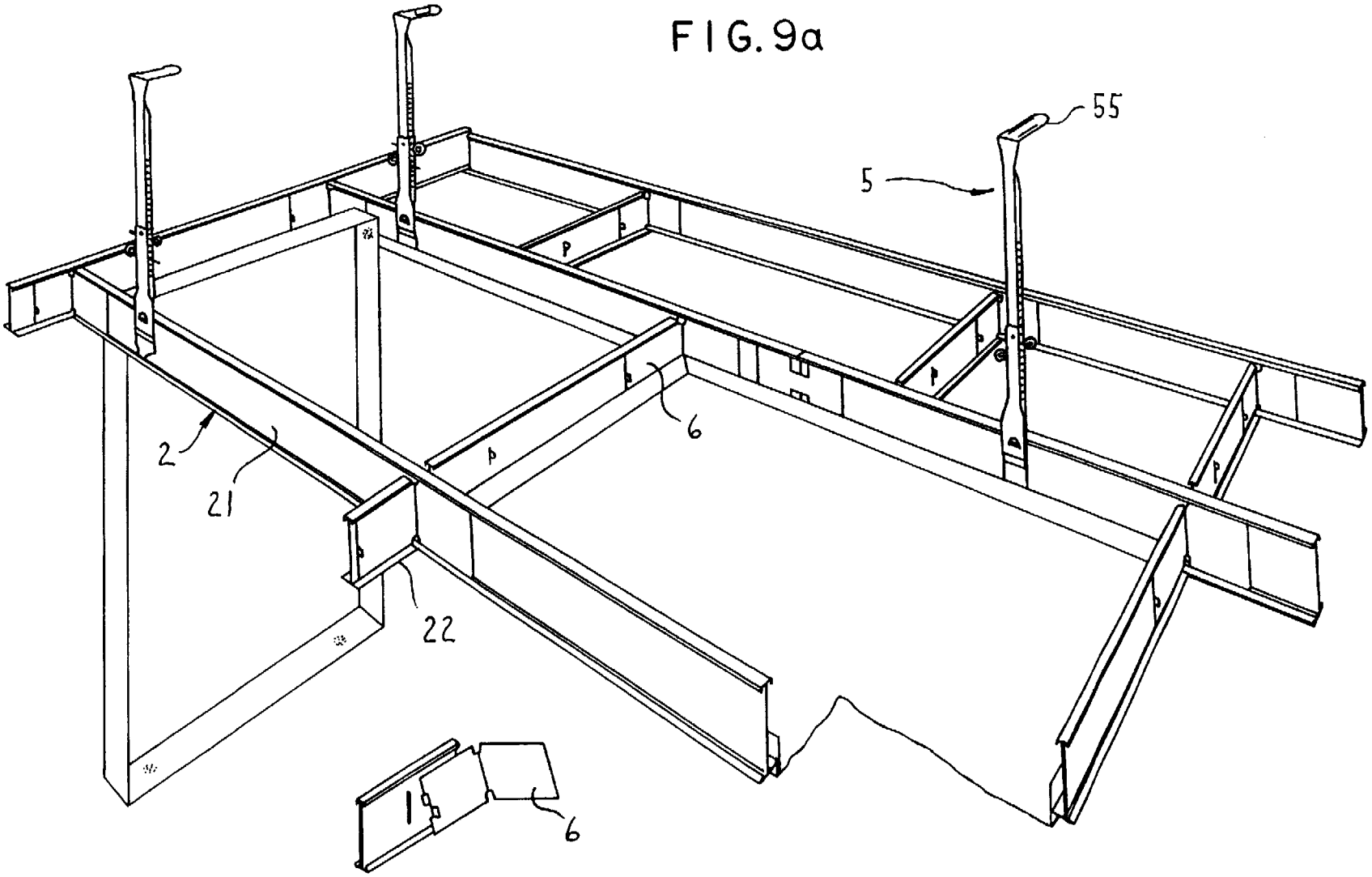

FIGS. 9, 9*a* show in a perspective view a ceiling which is fastened by means of supports 2 and suspensions 5 of the invention. The upper ends 55 of the suspensions are adjustable in length and are fastened to a subconstruction or a ceiling. The perpendicular connection of the supports 2 is advantageously done with corner elements 6, which are also moved into the oppositely lying guide grooves N1 and N2 between the adjacent supports. The ceiling tile 1 can alternatively also be placed onto the lower flange of the support 2 (FIG. 9).

Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

What is claimed is:

1. In a combination of a longitudinal or transverse support for a ceiling panelling holding construction formed generally of T-shaped, bent sheet-metal plates, and ceiling tiles adapted to form a surface image when each is inserted between two parallel supports and being releasably held on same, the improvement comprising:

(a) each support consisting of a sheet-metal base member having a T-form and a reinforcing sheet-metal member, (b) each sheet-metal base member being composed in one piece out of an integral double-wall first strip part constructing a cross piece of the T-form and a double-wall second strip part cantilevered vertically following from said double-wall first strip part, (c) the first strip part and the second strip part being bent out of a single first sheet-metal strip to form a horizontal outer strip segment and two inner strip segments and two vertically abutting strip segments, the horizontal outer strip segment abutting each of the two inner strip segments, (d) the first strip part being enveloped by the reinforcing sheet-metal member, (e) the reinforcing sheet-metal member being composed of one single second sheet-metal strip bent to conform to the form of the first strip part, (f) the first sheet-metal strip having first parallel edges on the second strip part, the first parallel edges being formed to define horizontal first guide grooves thereat, edges of the second sheet-metal strip being laterally spaced from the second strip part to define second guide grooves therebetween on both sides of the second strip part, the second guide grooves extending coextensively with the first guide grooves, and (g) holding pieces adapted to be secured to ceiling tiles being slidably receivable in the first and second guide grooves.

2. The combination according to claim 1, wherein the first guide grooves each have a semicircular cross section.

3. The combination according to claim 2, wherein the semicircular cross sections of the first guide grooves extend parallel to one another and each forms a fixed groove width.

4. The combination according to claim 1, wherein the holding pieces each have a flat sheet-metal piece and at least one holding element fastened to the sheet-metal piece adapted for securement to the associated ceiling tile.

5. The combination according to claim 4, wherein the holding element is releasably fastened to the sheet-metal piece.

6. The combination according to claim 4, wherein the holding element is adapted to form-lock into an associated recess in the ceiling tile.

7. The combination according to claim 4, wherein the holding element has a bolt shape and is adapted to project into an area of the associated ceiling tile.

8. The combination according to claim 1, wherein plate pieces are positioned in the guide grooves, and transverse supports are connected to the plate pieces.

9. The combination according to claim 1, wherein transverse supports have end areas which are received in the first and second guide grooves.

10. The support according to claim 1, wherein the ceiling tiles are each bent out of a sheet-metal blank.

11. The combination according to claim 10, wherein the ceiling tiles consist each of a flat, horizontal, preferably rectangular surface piece facing the room and being adjusted to the surface image, and edge pieces bent at a right angle on all sides relative to the surface piece, and the edge pieces lie in the area of the supports.

12. The combination according to claim 11, wherein the edge pieces are connected with one another at their abutting edges.

13. The combination according to claim 11, wherein the edge pieces have flanges extending from the edge pieces of the ceiling tile transversely with respect to the support, the flanges are integral with the edges of the ceiling tile and are adapted to be placed one on top of the other, thereby one of the abutting ceiling tiles is supported on one side by another adjacent ceiling tile and on the other side supports a second adjacent ceiling tile.

14. The combination according to claim 13, wherein at least one of the supports has a spacer fastened thereto, and wherein the edge pieces of adjacent ceiling tiles, which edge pieces are provided with flanges, abut on both sides of the spacer.

15. The combination according to claim 13, wherein the flanges are flat sheet-metal plates continuous with the edge pieces, which sheet-metal plates extend in the same direction when the edge pieces abut each other.

16. The combination according to claim 13, wherein the ceiling tile on its side supporting the next following ceiling tile is held on the adjacent support on both sides by at least one holding piece.

17. The combination according to claim 16, wherein the ceiling tile is pivotal about the holding elements provided on the sheet-metal pieces of the holding pieces.

18. The combination according to claim 1, wherein the supports are arranged such that the first strip part lies at the bottom serving as a support for the ceiling tiles.

19. The combination according to claim 18, wherein openings are provided in the second strip parts of the support, into which openings suspensions for the supports can be locked.

20. The combination according to claim 19, wherein the suspensions end in flat holding plates, which are moved into the double-wall second strip part of the respective support and are provided with spring pieces formed in one piece thereon, which spring pieces engage the openings in such a manner that they are thereby affixed to the support.

* * * * *